US008715105B2

(12) United States Patent
Stites et al.

(10) Patent No.: US 8,715,105 B2
(45) **Date of Patent: *May 6, 2014**

(54) GOLF CLUB HEAD HAVING AN INTERCHANGEABLE BRIDGE MEMBER

(75) Inventors: John T. Stites, Weatherford, TX (US); Gary G. Tavares, Azle, TX (US); Robert Boyd, Euless, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/474,662

(22) Filed: May 29, 2009

(65) Prior Publication Data

US 2010/0029406 A1 Feb. 4, 2010

Related U.S. Application Data

(63) Continuation-in-part of application No. 11/943,718, filed on Nov. 21, 2007, now Pat. No. 7,556,572, which is a continuation of application No. 11/181,578, filed on Jul. 13, 2005, now Pat. No. 7,300,361, which is a continuation of application No. 10/707,522, filed on Dec. 19, 2003, now Pat. No. 6,918,840, which is a continuation of application No. 10/666,346, filed on Sep. 19, 2003, now Pat. No. 6,923,732.

(30) Foreign Application Priority Data

Sep. 19, 2003 (WO) ..... PCT/IB03/05942

(51) Int. Cl.
*A63B 53/06* (2006.01)

(52) U.S. Cl.
USPC ..... 473/334; 473/349; 473/350; 473/291

(58) Field of Classification Search
USPC ..... 473/334–339, 349–350
See application file for complete search history.

(56) References Cited

U.S. PATENT DOCUMENTS

| | | | | |
|---|---|---|---|---|
| 1,133,129 | A * | 3/1915 | Govan | 473/337 |
| 2,155,830 | A | 4/1939 | Howard | |
| 2,846,228 | A | 8/1958 | Reach | |
| 3,655,188 | A | 4/1972 | Solheim | |
| 3,989,248 | A | 11/1976 | Campau | |
| D268,856 | S | 5/1983 | Fisher | |
| 4,398,965 | A | 8/1983 | Campau | |
| 4,826,172 | A | 5/1989 | Antonious | |

(Continued)

FOREIGN PATENT DOCUMENTS

| | | |
|---|---|---|
| GB | 232563 | 3/1925 |
| GB | 2316011 | 2/1998 |

(Continued)

OTHER PUBLICATIONS

Ben Hogan Irons, Apex Edge Pro CFT Iron, http://www.benhogan.com/products_irons_edgeCFT.html, Nov. 20, 2003.

(Continued)

*Primary Examiner* — Stephen L. Blau
(74) *Attorney, Agent, or Firm* — Banner & Witcoff, Ltd.

(57) ABSTRACT

A cavity back golf club head having an interchangeable bridge member is disclosed. The interchangeable bridge member extends across a rear cavity connecting a heel and a toe of the golf club head to control the trajectory of a golf ball.

19 Claims, 4 Drawing Sheets

(56) References Cited

U.S. PATENT DOCUMENTS

| | | | | |
|---|---|---|---|---|
| 5,082,278 | A | 1/1992 | Hsien | |
| 5,209,473 | A | 5/1993 | Fisher | |
| 5,264,533 | A | 11/1993 | Rehmer | |
| 5,282,625 | A | 2/1994 | Schmidt | |
| 5,290,036 | A | 3/1994 | Fenton | |
| 5,297,794 | A | 3/1994 | Lu | |
| 5,297,803 | A | 3/1994 | Solheim | |
| 5,328,184 | A | 7/1994 | Antonious | |
| 5,330,187 | A | 7/1994 | Schmidt | |
| 5,333,872 | A | 8/1994 | Manning | |
| 5,385,348 | A | 1/1995 | Wargo | |
| 5,395,113 | A | 3/1995 | Antonious | |
| 5,401,021 | A | 3/1995 | Allen | |
| 5,472,203 | A | 12/1995 | Schmidt | |
| 5,484,146 | A | 1/1996 | Loschiavo | |
| D371,182 | S | 6/1996 | Stites | |
| 5,549,297 | A | 8/1996 | Mahaffey | |
| 5,584,770 | A | 12/1996 | Jensen | |
| 5,586,947 | A | 12/1996 | Hutin | |
| 5,658,208 | A | 8/1997 | Shimasaki | |
| 5,738,596 | A | 4/1998 | Meyer | |
| 5,749,795 | A | 5/1998 | Schmidt | |
| 5,769,737 | A | 6/1998 | Holladay | |
| 5,833,551 | A * | 11/1998 | Vincent et al. | 473/350 |
| 5,873,795 | A | 2/1999 | Wozny | |
| 5,899,817 | A | 5/1999 | Dunikoski | |
| 5,899,821 | A * | 5/1999 | Hsu et al. | 473/332 |
| 5,916,042 | A | 6/1999 | Reimers | |
| 6,015,354 | A | 1/2000 | Ahn | |
| 6,030,295 | A | 2/2000 | Takeda | |
| 6,045,456 | A | 4/2000 | Best | |
| 6,077,173 | A * | 6/2000 | Stites | 473/334 |
| 6,080,069 | A | 6/2000 | Long | |
| 6,210,290 | B1 | 4/2001 | Erickson | |
| 6,277,032 | B1 | 8/2001 | Smith | |
| 6,280,348 | B1 | 8/2001 | Stites | |
| 6,290,607 | B1 | 9/2001 | Gilbert | |
| 6,315,678 | B1 | 11/2001 | Teramoto | |
| 6,406,382 | B1 | 6/2002 | Deshmukh | |
| 6,450,897 | B2 | 9/2002 | Stites | |
| 6,592,469 | B2 | 7/2003 | Gilbert | |
| 6,692,371 | B2 | 2/2004 | Berish | |
| D488,203 | S | 4/2004 | Madore | |
| 6,923,732 | B2 | 8/2005 | Stites | |
| 6,991,559 | B2 | 1/2006 | Yabu | |
| 7,300,361 | B2 | 11/2007 | Stites | |
| 7,476,162 | B2 | 1/2009 | Stites | |
| 2001/0014628 | A1 | 8/2001 | Erickson | |
| 2001/0044345 | A1 | 11/2001 | Stites | |
| 2001/0055996 | A1 | 12/2001 | Iwata | |
| 2003/0092502 | A1 | 5/2003 | Pergande | |
| 2003/0119601 | A1 | 6/2003 | Nelson et al. | |
| 2003/0199331 | A1 | 10/2003 | Stites | |
| 2003/0203764 | A1 | 10/2003 | Dabbs | |
| 2003/0228928 | A1 * | 12/2003 | Yabu | 473/290 |
| 2004/0176177 | A1 * | 9/2004 | Mahaffey et al. | 473/256 |
| 2005/0037864 | A1 | 2/2005 | Gilbert | |
| 2005/0239572 | A1 | 10/2005 | Roach | |
| 2008/0070722 | A1 | 3/2008 | Stites | |

FOREIGN PATENT DOCUMENTS

| | | |
|---|---|---|
| GB | 2365785 | 2/2002 |
| JP | 60-20261 | 2/1985 |
| JP | 08-257181 | 10/1996 |
| JP | 09135933 | 5/1997 |
| JP | 09-239077 | 9/1997 |
| JP | 9239077 | 9/1997 |
| JP | 09285576 | 11/1997 |
| JP | 10005377 | 1/1998 |
| JP | 10155948 | 6/1998 |
| JP | 11047322 | 2/1999 |
| JP | 11070192 | 3/1999 |
| JP | 11070194 | 3/1999 |
| JP | 2000005356 | 1/2000 |
| JP | 2000005357 | 1/2000 |
| JP | 2000093566 | 4/2000 |
| JP | 2000210400 | 8/2000 |
| JP | 2000345204 | 12/2000 |
| JP | 2001009070 | 1/2001 |
| JP | 2001046560 | 2/2001 |
| JP | 2001079124 | 3/2001 |
| JP | 2001087430 | 4/2001 |
| JP | 2001161870 | 6/2001 |
| JP | 2001190720 | 7/2001 |
| JP | 2001204863 | 7/2001 |
| JP | 2001314535 | 11/2001 |
| JP | 2002143355 | 5/2002 |
| JP | 2002186696 | 7/2002 |
| JP | 2002191729 | 7/2002 |
| JP | 2002253710 | 9/2002 |
| JP | 2003062132 | 3/2003 |
| JP | 2003-169870 | 6/2003 |
| JP | 2004-008565 | 1/2004 |
| JP | 2000334073 | 12/2009 |
| WO | 9315151 | 8/1993 |
| WO | 0010653 | 3/2000 |
| WO | 2004012492 | 2/2004 |
| WO | 2008008175 | 1/2008 |

OTHER PUBLICATIONS

Ben Hogan—Custom Options, http://www.benhogan.com/custom.html, Nov. 20, 2003.
International Search Report and Written Opinion for PCT/US2005/027630 mailed Feb. 15, 2006.
Office Action for U.S. Appl. No. 12/474,691 mailed Apr. 5, 2010.
Written Opinion and International Search Report for Application No. PCT/US2010/033492 mailed Sep. 15, 2010, 11 pages.
Decision of Rejection for Japanese Patent Application No. 2010-023336 dated Dec. 5, 2011.
International Search Report of PCT/US2004/042833 mailed May 10, 2005.
Revised Edition, 1975, The Random House College Dictionary (3 pages), Title page, copyright page, p. 168, Definition of "bridge".
Decision of Rejection for Japanese Patent Application No. 2010-023336 dated May 20, 2013.
Reasons for Rejection (with English translation) for Japanese Patent Application No. 2012-085302 dated Jul. 3, 2013.
"The Golf Club Identification and Price Guide III '50 to '93", The Golf Works, Jun. 1993, p. 19-7.
"The Golf Club Identification and Price Guide IV 1950 to 1998", GolfWorks Maltby, Nov. 1985, pp. 20-7 and 20-10.
Ben Hogan Apex Edge CFT Iron Publication, 5 pages.
Ben Hogan Golf 2004, Edge CFT Hydrids "h" Iron Set, Same Great Edge CFT Technology . . . Improved by Including Two CFT Hybrids, copyright Callaway Golf Company, 2004, 4 pages.
International Search Report for PCT/IB03/05942 dated Jun. 30, 2004, 5 pages.
Office Action for U.S. Appl. No. 13/608,826 dated Oct. 23, 2013.
EP Communication dated Nov. 4, 2013 for EP Application No. 10718791.6-1658.
EP Communication dated Dec. 11, 2013, for EP Application No. 05782555.6-1655.
Notice of Reasons for Rejection (English translation) dated Jan. 22, 2014, for JP Application No. 2012-513086.
Office Action dated Oct. 31, 2013, for CN Application No. 2013102801140930.

* cited by examiner

FIG.3
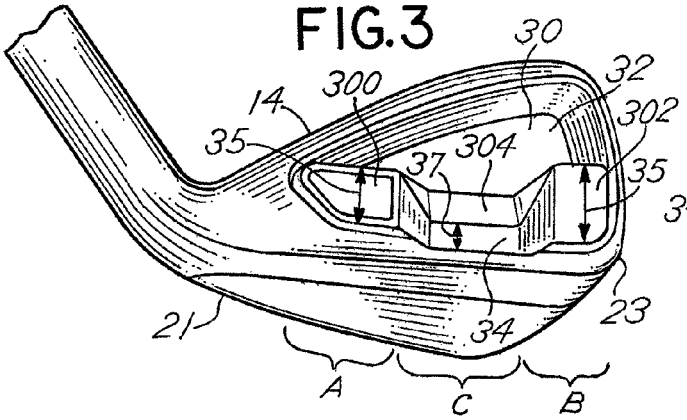
FIG.4
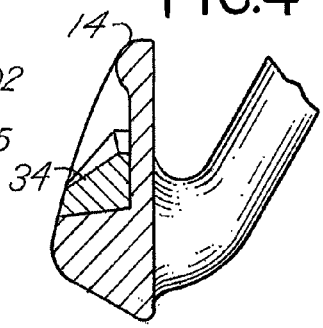
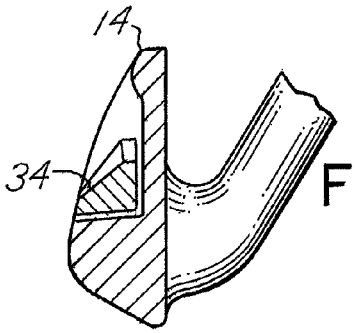
FIG.4A
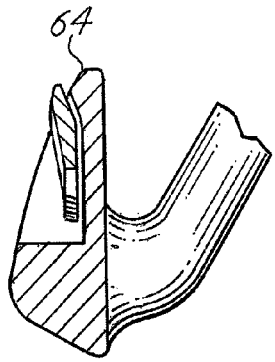
FIG.6A
FIG.5
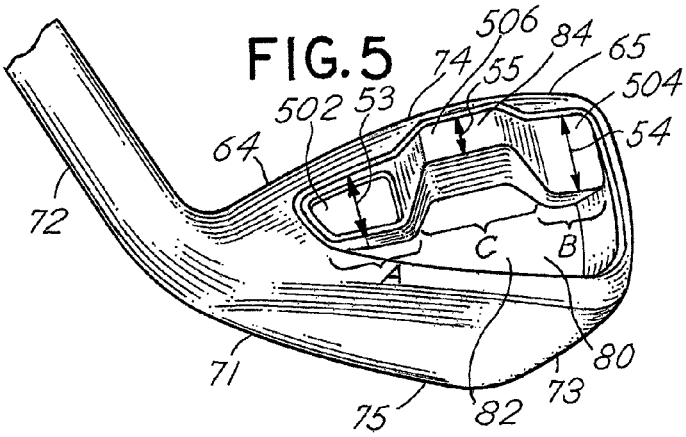
FIG.6
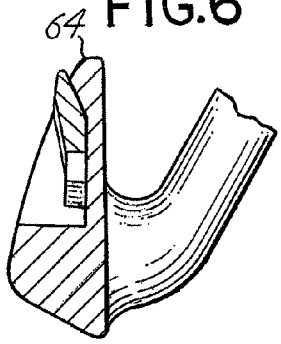

GOLF CLUB HEAD HAVING AN INTERCHANGEABLE BRIDGE MEMBER

This application is a continuation-in-part application of U.S. patent application Ser. No. 11/943,718, filed Nov. 21, 2007 which a continuation application of U.S. patent application Ser. No. 11/181,578, filed Jul. 13, 2005, now U.S. Pat. No. 7,300,361, issued Nov. 27, 2007, which is a continuation application of U.S. patent application Ser. No. 10/707,522, filed Dec. 19, 2003, now U.S. Pat. No. 6,918,840, issued Jul. 19, 2005, which is a continuation of International Application No. PCT/IB03/05942, filed on Dec. 15, 2003, which claims priority to, and is a continuation of U.S. application Ser. No. 10/666,346, filed Sep. 19, 2003, now U.S. Pat. No. 6,923,732, issued Aug. 2, 2005. The prior-applications are hereby incorporated by reference in their entireties.

FIELD OF THE INVENTION

The present invention relates to golf club heads. More particularly, the invention concerns cavity back golf club heads having an interchangeable bridge member extending across a rear cavity.

BACKGROUND

Various golf club heads have been designed to improve a golfer's accuracy by assisting a golfer to square the club head face at impact with a golf ball. A number of these golf club heads reposition the weight of the golf club head in order to alter the location of the center of gravity. The location of the center of gravity of the golf club head is one factor that determines whether a golf ball is propelled in the intended direction. When the center of gravity is positioned behind the point of engagement on the contact surface, the golf ball follows in a generally straight route. When the center of gravity is spaced to a side of the point of engagement, however, the golf ball may follow a route that curves left or right, which is often referred to as a hook or a slice. Similarly, when the center of gravity is spaced above or below the point of engagement, the route of the golf ball may exhibit a boring or climbing trajectory.

Golf club heads such as the cavity back club heads assist the golfer by locating the weight of the golf club head around the golf club head perimeter. Generally, these golf club heads are more forgiving than non-cavity golf club heads thereby allowing a golf ball to be struck off center or miss-hit, while still providing relatively good distance and accuracy. The control of the trajectory of a golf ball is limited by the limited control over the center of gravity of a golf club head. Therefore, there is a need in the art for a golf club head that repositions additional weight away from the golf club head face to further shift the center of gravity of a golf club head.

BRIEF SUMMARY

One or more of the above-mentioned needs in the art are satisfied by the disclosed golf club head of the present invention. The cavity back golf club head of the present invention may include a removable bridge member where the center of gravity is located between the bridge member and the rear of the club head face. The removable bridge member may be interchangeable with other shaped and/or sized removable bridge members. The interchangeable bridge member provides additional weight towards the rear of the club head to shift the center of gravity of the golf club head further behind the point of engagement. The shifting of weight towards the rear of the golf club head influences the trajectory of the ball upon impact.

In an aspect of the invention, the interchangeable bridge member may include at least one weight that may be changed with a plurality of different shaped weights. In an embodiment, the weights may be of different densities and compositions.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The present invention is illustrated by way of example and not limited in the accompanying figures in which like reference numerals indicate similar elements and in which:

FIG. 3 illustrates a rear view of a golf club head in accordance with an aspect of the invention;

FIG. 4 illustrates a cross-sectional view of a golf club head in accordance with an aspect of the invention;

FIG. 4*a* illustrates another cross-sectional view of a golf club head in accordance with an aspect of the invention;

FIG. 5 illustrates another rear view of a golf club head in accordance with an aspect of the invention;

FIG. 6 illustrates a cross-sectional view of FIG. 5 for a golf club head in accordance with an aspect of the invention;

FIG. 6*a* illustrates another cross-sectional view of FIG. 5 for a golf club head in accordance with an aspect of the invention;

DETAILED DESCRIPTION

The following discussion and accompanying figures disclose various golf club heads in accordance with the present invention. For example, the golf club heads of the present invention may be utilized for the long iron clubs and the short iron clubs.

Figure 1:
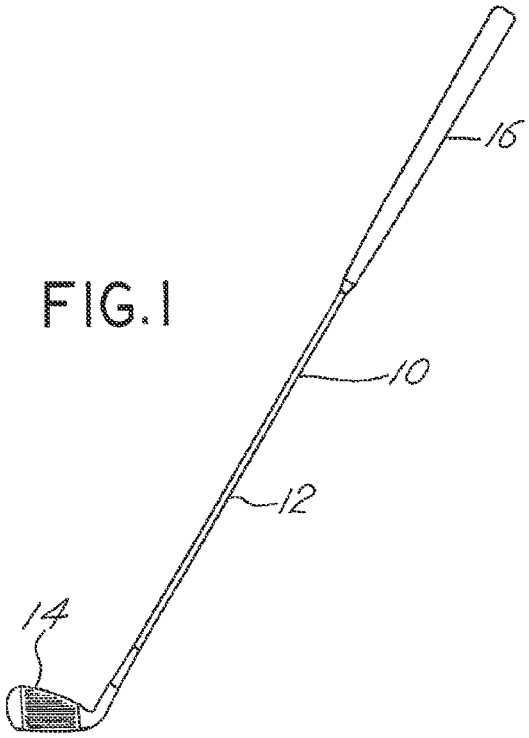
FIG. 1 illustrates an elevational view of a golf club having a golf club head in accordance with an aspect of the invention.

Referring to FIG. 1, golf club 10 includes a shaft 12 and a golf club head 14. The golf club head 14 of FIG. 1 may be representative of a two iron golf club head according to an embodiment of the invention. The shaft 12 of golf club 10 may be made of various materials such as steel, titanium, graphite, or a composite material. A grip 16 is positioned on the shaft 12 to provide a golfer with a slip resistant surface in which to grasp golf club 10.

Figure 2:
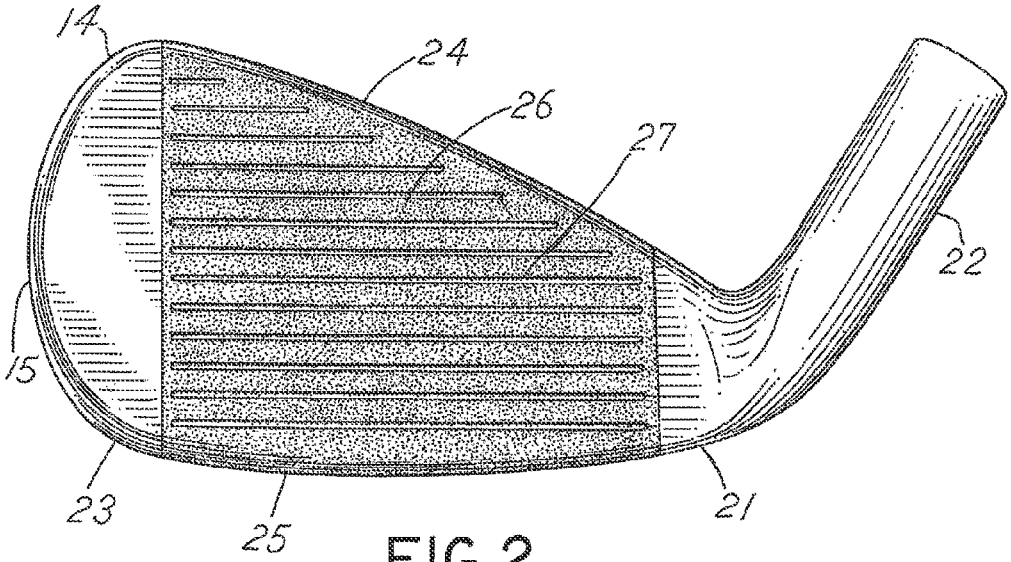
FIG. 2 illustrates a front view of a golf club head in accordance with an aspect of the invention.

As shown in FIG. 2, the golf club head 14 comprises a body 15 that includes a heel 21 and toe 23. The heel 21 is attached to a hosel 22 for connecting the shaft 12 of FIG. 1 to the golf club head 14. The body 15 also includes a top portion 24 and a sole portion 25. A striking face 26 is connected between the top portion 24 and the sole portion 25, and between the toe 23 and the heel 21. The striking face 26 provides a contact area for engaging and propelling a golf ball in an intended direction. The striking face 26 comprises horizontal grooves 27 for the removal of water and grass from the striking face 26. The body 15 of golf club head 14 may be constructed of various materials such as steel, titanium, aluminum, tungsten, graphite, polymers, or composites.

FIG. 3 illustrates a rear view of a golf club head 14 in accordance with an aspect of the invention. In an embodiment, golf club head 14 includes a rear face 30 positioned opposite the striking face 26 (FIG. 2). The rear face 30 forms a rear cavity 32 having a large opening extending towards the rear face 30. An interchangeable bridge member 34 extends across the rear cavity 32 which may connect the heel 21 to the toe 23. Interchangeable bridge member 34 may also be extended across the rear cavity 32 and connected to various other locations on the golf club head 14 as shown, for example, in U.S. Pat. No. 6,450,897 issued on Sep. 17, 2002, which is hereby incorporated by reference in its entirety. Interchangeable bridge member 34 may be made of various shapes such as rectangle, oval, triangle, trapezoid, square or other symmetrical or asymmetrical shapes. In addition, interchangeable bridge member 34 may be made of compound shapes. In another additional embodiment, interchangeable bridge member 34 may also have a non-uniform width or thickness throughout its length.

In an aspect of the invention, different interchangeable bridge members may be used with the same golf club head to form a complete set of iron golf clubs. For instance, FIG. 3 illustrates an interchangeable bridge member 34 that may be used in the longer club irons such as a two iron through four iron. For example, on the longer iron clubs, two iron through four iron, it is desirable to have the center of gravity lower than on the shorter iron clubs. On the longer iron clubs, a lower center of gravity will assist a golfer with obtaining additional loft on their golf shot. The interchangeable bridge member 34 for longer iron clubs is positioned lower on the rear of the golf club head body 14 as compared to a bridge member on a shorter iron club.

In an aspect of the invention, interchangeable bridge member 34 may comprise a first portion 300 having a first height dimension 35 in an area A adjacent the heel 21, a second portion 302 having a second height dimension 36 in an area B adjacent the toe 23, and a third portion 304 having a third height dimension 37 in an area C between the heel 21 and toe 23. In an embodiment, the third height dimension 37 may be less than the height of the first height dimension 35 and the second height dimension 36.

In another embodiment, the third portion 304 may be connected to the first portion 300 and the second portion 302. The third portion 304 may be offset from the first portion 300 and second portion 302 in a direction towards the sole portion 25. The third portion 304 which is offset from the first and second portions (300 and 302) may provide additional varying of the center of gravity of the golf club head with respect to the striking face.

In another aspect of the invention, the interchangeable bridge member 34 may be comprised of different materials such as steel, titanium, aluminum, tungsten, graphite, polymers, or composites. For instance, in an embodiment interchangeable bridge member 34 may be composed of titanium in areas A and B (adjacent heel 21 and toe 23) and tungsten in area C (in between heel 21 and toe 23). As those skilled in the art will realize, each area may be made of different materials which include thermoplastic composite materials such as acrylonitrile butadiene styrenes (ABS), polyether block amides (COPA), polyamide alloys, polyamide 12 (PA12), high density polyethylene (HDPE), polypropylene random co-polymer (PP), and thermoplastic polyurethanes (TPU), these materials marketed under the name Ecomass® compounds.

In an embodiment, interchangeable bridge member 34 may be connected to the toe 23 and heel 21 using screws (not shown). Those skilled in the art will realize that interchangeable bridge member 34 may be connected to the toe 23 and the heel through numerous other connection means which fall within the scope of the present invention. For example, interchangeable bridge member 34 may also include a slot (not shown) on one side of the interchange bridge member 34 to be connected to a tab formed in a portion of golf club head 14. In an embodiment, the other side of the interchangeable bridge member 34 may be secured with a mechanical fastener such as a set screw. In an embodiment, the set screw may be covered to hide the fastener from view.

FIG. 4 illustrates a cross-sectional view the golf club head 14 of FIG. 3 in accordance with an aspect of the invention. In an aspect of the invention, bridge member 34 may be in contact with rear face 30 and sole portion 25. In another embodiment, as shown in FIG. 4*a*, bridge member 34 may not be contact with rear face 30 and sole portion 25 but rather spaced apart from both rear face 30 and sole portion 25.

During the game of golf, an individual holds grip 16 and swings golf club 10 such that golf club head 14 traverses a generally arcuate path and impacts a golf ball. A portion of the inertia of golf club 10, and particularly the inertia of golf club head 14, is then transferred to the golf ball and propels the golf ball toward an intended target. The position of a center of gravity of head 14 has an influence upon whether the golf ball curves right, curves left, or follows a generally straight route. More specifically, the golf ball follows a generally straight route when the center of gravity is positioned behind the point of engagement on striking face 26. When the center of gravity is spaced to one side of the point of engagement, however, the golf ball may follow a route that curves left or right. The position of the center of gravity of golf club head 14 also has an influence upon whether the golf ball exhibits a boring or climbing trajectory, depending upon whether the center of gravity is spaced above or below the point of engagement on striking face 26.

Although the concepts behind utilizing a golf club to propel a golf ball toward an intended target appear simplistic, the actual practice of propelling the golf ball in an intended manner is exceedingly complex. The golf ball may, for example, consistently curve right when, in fact, the individual intends to propel the golf ball along a straight route. Many conventional golf club heads have a center of gravity located at the striking face 26. However, changing the position of the center of gravity of the golf club head 14 for different golf clubs may assist many golfers in squaring the club head face 14 upon impact with a golf ball. The positioning of the center of gravity off of the striking face 26 and towards the rear of the golf club head 14 may conform to the style and preferences of many golfers. Accordingly, these golfers may be able to correct or modify the route of the golf ball by using the golf club head 14 of the present invention as the center of gravity of golf club head 14 is repositioned with respect to striking face 26 as compared to other golf club heads.

The center of gravity of golf club head 14, otherwise referred to as the center of mass, is defined as an equilibrium point. More specifically, the center of gravity of golf club head 14 is a point at which the entire weight of golf club head 14 may be considered as concentrated so that, if supported at that point, head 14 would remain in static equilibrium in any position. The center of gravity of golf club head 14 may be changed by altering the weight distribution of the golf club head 14 away from the striking face 26. Altering the weight distribution of golf club head 14 may be accomplished with the use of interchangeable bridge member 34.

Interchangeable bridge member 34 increases the weight of the back of the golf club head 14 relative to the striking face 26 of the golf club head 14. This increase in weight towards the rear of golf club head 14 alters the center of gravity of golf club head 14. By moving the center of gravity lower and towards the rear of the golf club head, the golf club 10 will tend to have an increased loft upon impact. In addition, the shape and location of interchangeable bridge member 34 may also influence the location of the center of gravity of golf club head 14. For example, on the longer iron clubs it is desirable to have the center of gravity lower than on the shorter iron clubs. On the longer iron clubs, a lower center of gravity will assist a golfer with obtaining additional loft on their golf shot. The interchangeable bridge member 34 for longer iron clubs is positioned lower on the rear of the golf club head body 14 as compared to a bridge member on a shorter iron club.

FIG. 5 illustrates another rear view of a golf club head in accordance with an additional aspect of the invention. In an embodiment, FIG. 5 illustrates a golf club head 64 for use in a golf club such as a pitching wedge. As shown in FIG. 5, the golf club head 64 comprises a body 65 that includes a heel 71 and toe 73. The heel 71 is attached to a hosel 72 for connecting a shaft to the golf club head 64. The body 65 also includes a top portion 74 and a sole portion 75. A striking face is connected between the top portion 74 and the sole portion 75, and between the toe 73 and the heel 71. The striking face provides a contact area for engaging and propelling a golf ball in an intended direction. The striking face comprises horizontal grooves for the removal of water and grass from the striking face. The body 65 of golf club head 64 may be constructed of various materials such as steel, titanium, aluminum, tungsten, graphite, polymers, or composites.

In FIG. 5, the golf club head 64 includes a rear face 80. The rear face 80 forms a rear cavity 82 having a large opening extending towards rear face 80. An interchangeable bridge member 84 extends across the rear cavity 82 connecting the heel 71 to the toe 73. Interchangeable bridge member 84 may also be extended across the rear cavity 82 and connected to various other locations on the golf club head 64 as shown, for example, in U.S. Pat. No. 6,450,897 issued on Sep. 17, 2002, which is hereby incorporated by reference in its entirety. Interchangeable bridge member 84 may be made of various shapes such as rectangle, oval, triangle, trapezoid, square or other symmetrical or asymmetrical shapes. Interchangeable bridge member 84 may also have a non-uniform width or thickness throughout its length.

In an aspect of the invention, different interchangeable bridge members may be used with the same golf club head to form a complete set of iron golf clubs. For instance, FIG. 5 illustrates an interchangeable bridge member 84 that may be used in the shorter club irons such as in a seven iron through pitching wedge. For example, on the shorter iron clubs, six iron through pitching wedge, it is desirable to have the center of gravity higher than on the longer iron clubs. On the shorter iron clubs, a higher center of gravity will enable a golfer to have greater control over the flight of the golf ball. The bridge member 84 for shorter iron clubs is positioned higher on the rear of the golf club head body 65 as compared to a bridge member on longer iron clubs. The interchangeable bridge member 84 for shorter iron clubs is positioned higher on the rear of the golf club head body 65 as compared to a bridge member on a longer iron club.

In an aspect of the invention, interchangeable bridge member 84 may comprise a first portion 502 having a first height dimension 53 in an area A adjacent the heel 71, a second portion 504 having a height dimension 54 in an area B adjacent the toe 73, and a third portion 506 having a height dimension 55 in an area C between the heel 71 and toe 73. In an embodiment, the third height dimension 55 may be less than the height of the first height dimension 53 and second height dimension 54.

In another embodiment, the third portion 506 may be connected to the first portion 502 and the second portion 504. The third portion 506 may be offset from the first portion 502 and second portion 504 in a direction towards the top portion 74. The third portion 506 which is offset from the first and second portions (502 and 504) may provide additional varying of the center of gravity of the golf club head with respect to the striking face.

In another aspect of the invention, the interchangeable bridge member 84 may be comprised of different materials such as steel, titanium, aluminum, tungsten, graphite, polymers, or composites. For instance, in an embodiment interchangeable bridge member 84 may be composed of titanium in area C (in between heel 71 and toe 73) and tungsten in areas A and B (adjacent heel 71 and toe 73).

In an embodiment, interchangeable bridge member 84 may be connected to the toe 73 and heel 71 using screws (not shown). Those skilled in the art will realize that interchangeable bridge member 84 may be connected to the toe 73 and the heel 71 through numerous other connection means which fall within the scope of the present invention. For example, interchangeable bridge member 84 may also include a slot (not shown) on one side of the interchange bridge member 84 to be connected to a tab formed in a portion of golf club head 84. In an embodiment, the other side of the interchangeable bridge member 84 may be secured with a mechanical fastener such as a set screw. In an embodiment, the set screw may be covered to hide the fastener from view.

FIG. 6 illustrates a cross-sectional view the golf club head 64 of FIG. 5 in accordance with an aspect of the invention. In an aspect of the invention, bridge member 84 may be in contact with rear face 80 and top portion 74. In another embodiment, as shown in FIG. 6*a*, bridge member 84 may not be contact with rear face 80 and top portion 74 but rather spaced apart from both rear face 80 and top portion 74.

Interchangeable bridge member 84 increases the weight of the back of the golf club head 64 relative to the striking face of the golf club head 64. This increase in weight towards the rear of golf club head 64 alters the center of gravity of golf club head 64. By moving the center of gravity higher and towards the rear of the golf club head, a golf ball may be propelled with a lower and more controlled trajectory.

The shape and location of interchangeable bridge member 84 may also influence the location of the center of gravity of golf club head 64. For example, on the shorter iron clubs, six iron through pitching wedge, it is desirable to have the center of gravity higher than on the longer iron clubs. On the shorter iron clubs, a higher center of gravity will enable a golfer to have greater control over the flight of the golf ball. Interchangeable bridge member 84 for shorter iron clubs is positioned higher on the rear of the golf club head body 64 as compared to a bridge member on longer iron clubs.

Figure 7:
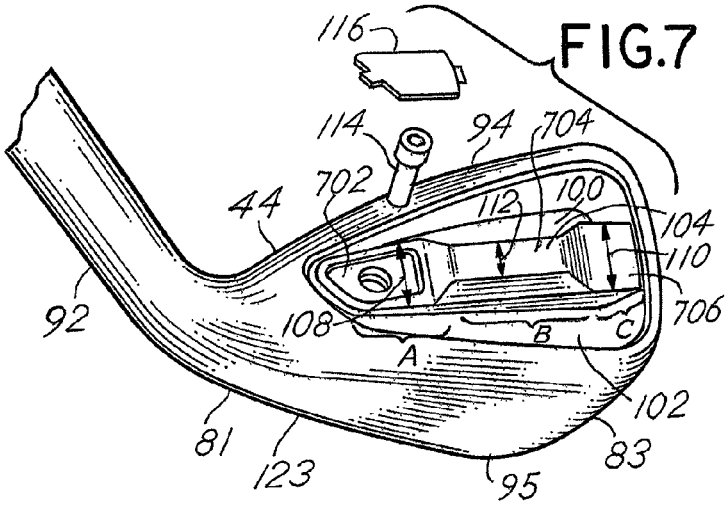
FIG. 7 illustrates an additional rear view of a golf club head in accordance with an aspect of the invention.

FIG. 7 illustrates another rear view of a golf club head in accordance with an aspect of the invention. In an embodiment, FIG. 7 illustrates a golf club head 44 for use in a golf club such as a five or six iron. As shown in FIG. 7, the golf club head 44 comprises a body 123 that includes a heel 81 and toe 83. The heel 81 is attached to a hosel 92 for connecting a shaft to the golf club head 44. The body 123 also includes a top portion 94 and a sole portion 95. A striking face is connected between the top portion 94 and the sole portion 95, and between the toe 83 and the heel 81. The striking face provides a contact area for engaging and propelling a golf ball in an intended direction. The striking face comprises horizontal grooves for the removal of water and grass from the striking face. The body 123 of golf club head 44 may be constructed of various materials such as steel, titanium, aluminum, tungsten, graphite, polymers, or composites.

In FIG. 7, the golf club head 44 includes a rear face 100. The rear face 100 forms a rear cavity 102 having a large opening extending towards rear face 100. An interchangeable bridge member 104 extends across the rear cavity 102 connecting the heel 81 to the toe 83. Interchangeable bridge member 104 may also be extended across the rear cavity 102 and connected to various other locations on the golf club head 44 as shown, for example, in U.S. Pat. No. 6,450,897 issued on Sep. 17, 2002, which is hereby incorporated by reference in its entirety. Interchangeable bridge member 104 may be made of various shapes such as rectangle, oval, triangle, trapezoid, square or other symmetrical or asymmetrical shapes. Interchangeable bridge member 104 may also have a non-uniform width or thickness throughout its length.

Figure 7A:
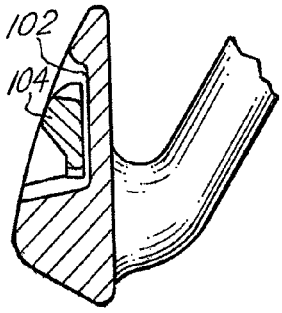
FIG. 7*a* illustrates a cross-sectional view of FIG. 7 for a golf club head in accordance with an aspect of the invention.

In another aspect of the invention, as shown in FIG. 7*a*, bridge member 104 may not be contact with rear face 100 but rather spaced apart from rear face 100 and top portion 74.

In an aspect of the invention, different interchangeable bridge members may be used with the same golf club head to form a complete set of iron golf clubs. For instance, FIG. 7 illustrates an interchangeable bridge member 104 that may be used as a five or six iron.

In an aspect of the invention, interchangeable bridge member 104 may comprise a first portion 702 having a height dimension 108 in an area A adjacent the heel 81, a second portion 706 have a height dimension 110 in an area C adjacent the toe 83, and a third portion 704 having a height dimension 112 in an area B between the heel 81 and toe 83. In an embodiment, the third height dimension 112 may be less than the height of the first height dimension 108 and second height dimension 110.

In another embodiment, the third portion 704 may be connected to the first portion 702 and the second portion 706. The third portion 704 may be substantially aligned with the first portion 702 and the second portion 706 to provide a center of gravity of the club head substantially in the geometric center of the club head.

In another aspect of the invention, the interchangeable bridge member 104 may be comprised of different materials such as steel, titanium, aluminum, tungsten, graphite, polymers, or composites. For instance, in an embodiment interchangeable bridge member 104 may be composed of titanium in areas A and C (adjacent heel 81 and toe 83) and tungsten in area B (in between heel 81 and toe 83).

In an embodiment, interchangeable bridge member 104 may be connected to the toe 83 and heel 81 using set screw 114. Those skilled in the art will realize that interchangeable bridge member 104 may be connected to the toe 83 and the heel 81 using fewer or additional connection points and through numerous other connection means which fall within the scope of the present invention. For example, interchangeable bridge member 104 may also include a slot (not shown) on one side of the interchange bridge member 104 to be connected to a tab formed in a portion of golf club head 44. In an embodiment, the other side of the interchangeable bridge member 104 may be secured with a mechanical fastener such as a set screw. In an embodiment, the set screw 114 may be covered with a plate 116 to hide set screw 114 from view.

Bridge member 104 increases the weight of the back of the golf club head 44 relative to the striking face of the golf club head 44. This increase in weight towards the rear of golf club head 44 alters the center of gravity of golf club head 44.

The shape and location of bridge member 104 may also influence the location of the center of gravity of golf club head 44. For example, on a five or six iron it may be desirable to have the center of gravity toward the middle of the club head 44. For instance, FIG. 7 illustrates interchangeable bridge member 104 in a neutral position or placed towards the center of golf club head 44.

Figure 8:
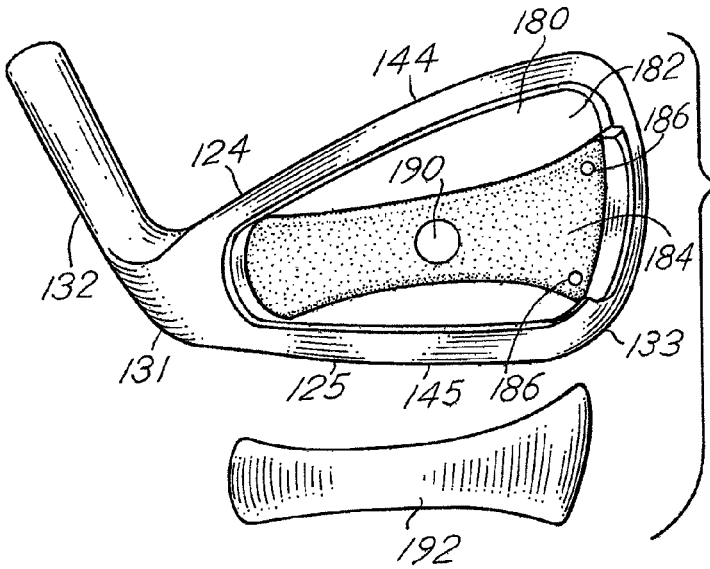
FIG. 8 illustrates a further additional rear view of a golf club head in accordance with an aspect of the invention.

FIG. 8 illustrates a further additional rear view of a golf club head in accordance with an aspect of the invention. In FIG. 8, golf club head 124 comprises a body 125 that includes a heel 131 and toe 133. The heel 131 is attached to a hosel 132 connecting a shaft to golf club head 124. The body 125 also includes a top portion 144 and a sole portion 145. A striking face is connected between the top portion 144 and the sole portion 145, and between the toe 133 and the heel 131. The striking face provides a contact area for engaging and propelling a golf ball in an intended direction.

In an aspect of the invention, golf club head 124 of the present invention includes a rear face 180 positioned opposite the striking face. The rear face 180 forms a first rear cavity 182 having a large opening extending towards rear face 180. An interchangeable bridge member 184 extends across the first rear cavity 182 connecting the heel 131 to the toe 133. Interchangeable bridge member 184 may also be extended across the first rear cavity 182 and connected to various other locations on the golf club head 124 as shown, for example, in U.S. Pat. No. 6,450,897 issued on Sep. 17, 2002, which is hereby incorporated by reference in its entirety. Interchangeable bridge member 184 may be made of various shapes such as rectangle, oval, triangle, trapezoid, square or other symmetrical or asymmetrical shapes. Interchangeable bridge member 184 may also have a non-uniform width or thickness throughout its length.

Interchangeable bridge member 184 may be connected to the toe 133 and heel 131 using screws 186. Those skilled in the art will realize that bridge member 184 may be connected to the toe 133 and the heel 131 using fewer or additional connection points and through numerous other connection means which fall within the scope of the present invention. In an embodiment, an interchangeable weight 190 may be included in interchangeable bridge member 184. The weight 190 may be composed of different materials such as steel, titanium, aluminum, tungsten, graphite, polymers, and/or composites. A cover 192 may be used to cover weight 190. Those skilled in the art will realize that additional weights and or configurations of weights may be used in interchangeable bridge member 184.

Figure 9:
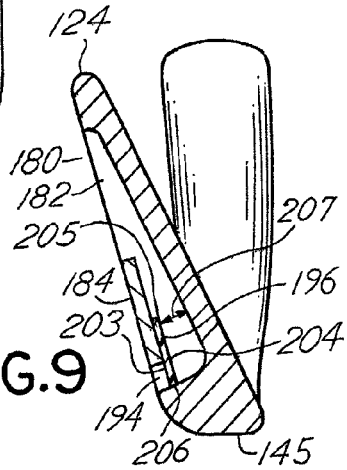
FIG. 9 illustrates a cross-sectional view of FIG. 8 for a golf club head in accordance with an aspect of the invention.

FIG. 9 illustrates a cross-sectional view of FIG. 8 in accordance with an aspect of the invention. As shown in FIG. 9, a second rear cavity 194 may be located below interchangeable bridge member 184. A wall 196 may extend from the sole 145 to the interchangeable bridge member 184. The wall 196 creates the second rear cavity 194 having an opening positioned below interchangeable bridge member 184. The wall 196 may comprise a front surface 203, a back surface 204, a top surface 205, and a bottom surface 206. A space 207 may exist between back surface 204 of wall 196 and the rear face 180 of the golf club head 124.

Wall 196 may be linear or curved depending upon the shape of interchangeable bridge member 184. Club head 124, wall 196, and interchangeable bridge member 184 may be made of various materials such as stainless steel, titanium, graphite, plastic, or a composite material. The additional support and stiffness of interchangeable bridge member 184 may prevent any deformation of interchangeable bridge member 184 upon contact with a golf ball. In addition, the wall 196 may provide a vibration damping effect upon impact of striking face with a golf ball.

In an embodiment, front surface 203 and the bottom surface 206 of wall 196 may be secured to the interchangeable bridge member 184 and sole portion 145 using an adhesive. Those skilled in the art will realize that numerous other ways exist to attach front surface 203 and bottom surface 206 to the interchangeable bridge member 184 and sole portion 145, respectively. These numerous other ways of attachment are contemplated and fall within the scope of the present invention.

Interchangeable bridge member 184 increases the weight of the back of the golf club head 124 relative to the striking face of the golf club head 124. This increase in weight towards the rear of golf club head 124 alters the center of gravity of golf club head 124.

The lowering of the center of gravity of golf club head 124 may also be accomplished through the use of wall 196. Wall 196 increases the weight on the back of the golf club head 124 relative to the striking face. This increase in weight to the back of golf club head 124 relative to the striking face raises the center of gravity of golf club head 64 allowing the golf club head to propel a golf ball with a lower and more controlled trajectory.

Figure 10:
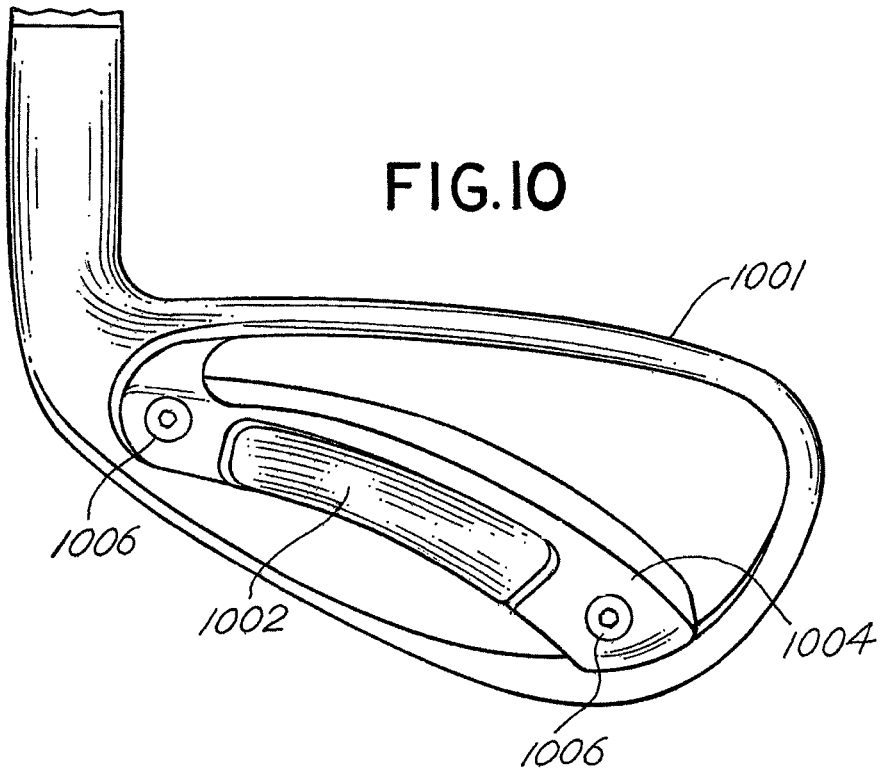
FIG. 10 illustrates yet another rear view of a golf club head in accordance with an aspect of the invention.

FIG. 10 illustrates yet another rear view of a golf club head 1001 in accordance with an aspect of the invention. In FIG. 10, a fluid filled bladder 1002 may be formed in interchangeable bridge member 1004. The fluid filled bladder 1002 may comprise a gas filled bladder.

The bladder 1002 may be made of any desired materials, formed in any desired manner (e.g., polymeric materials formed by blow molding, etc.), without departing from this invention. As some more specific examples, the bladder 1002 may be made from resilient, thermoplastic, elastomeric barrier films, such as polyester polyurethanes, polyether polyurethanes (such as cast or extruded ester based polyurethane films, e.g., Tetra Plastics TPW-250); thermoplastic urethanes, such as PELLETHANE™ (a product of the Dow Chemical Company of Midland, Mich.), ELASTOLLAN® (a product of the BASF Corporation), and ESTANE® (a product of the B.F. Goodrich Co.), all of which are either ester or ether based; thermoplastic urethanes based on polyesters, polyethers, polycaprolactone, and polycarbonate macrogels; thermoplastic films containing crystalline material, such as those disclosed in U.S. Pat. Nos. 4,936,029 and 5,042,176 to Rudy, each of which is entirely incorporated herein by reference; polyurethane including a polyester polyol, such as those disclosed in U.S. Pat. No. 6,013,340 to Bonk et al., which is entirely incorporated herein by reference; and/or multi-layer films formed of at least one elastomeric thermoplastic material layer and a barrier material layer formed of a copolymer of ethylene and vinyl alcohol, such as those disclosed in U.S. Pat. No. 5,952,065 to Mitchell et al., which also is entirely incorporated herein by reference. Gas-filled bladder materials and/or members of the types used in "AIR" type footwear products and/or other footwear products commercially available from NIKE, Inc. of Beaverton, Oreg. also may be used as gas-filled bladder 1002 without departing from this invention.

Also, any gas or other fluid may be used to fill bladder 1002 without departing from this invention, including air, inert gases, liquids, etc. The filling gas or fluid may be under pressure, under vacuum, or under standard or atmospheric conditions without departing from this invention. If desired, the fluid filled bladder 1002 may be sealed or vented to the atmosphere.

The fluid filled bladder 1002 may be flexible, such that it readily conforms to the shape of the interior of interchangeable bridge member 1004 into which it is fit. The fluid filled bladder may be somewhat conformable, it may be relatively rigid, such that it substantially holds its shape under applied force, or it may be very rigid. Such rigidity/conformability features may depend on the overall structure of the bladder 1002, such as its wall thicknesses; materials; molding structures or features; the presence or absence of support structures. Also, any number of additional independent chambers (optionally interconnected chambers) may be provided in a single fluid filled bladder 1002 and/or any number of fluid filled bladders 1002 may be provided in an overall club head structure 1001 without departing from the scope of the invention.

In an aspect of the invention, various interchangeable bridge members having different fluid filled bladders may be used to change the characteristics of a golf club head. The different interchangeable bridge members may be changed through loosening of set screws 1006. In an embodiment, a golf club head using different interchangeable bridge members may be used to form a complete set of iron golf clubs.

Figure 11:
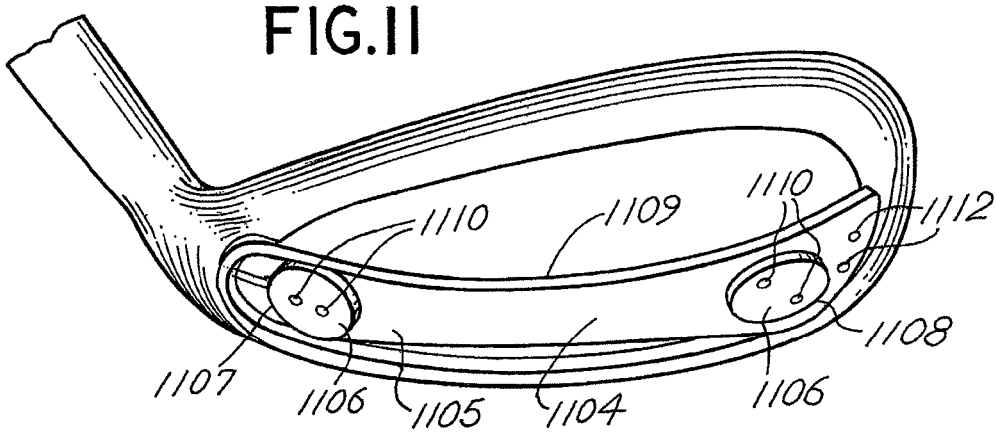
FIG. 11 illustrates an additional rear view of a golf club head in accordance with an aspect of the invention.

FIG. 11 illustrates an additional rear view of a golf club head in accordance with an aspect of the invention. In FIG. 11, interchangeable bridge member 1104 may have weights 1106 attached to the front surface 1105 of interchangeable bridge member 1104 at various fixed locations. For example, weights 1106 may be attached to the front surface 1105 of bridge member 1104 closer to the heel 1107 and toe 1108 of the golf club head. Those skilled in the art will realize that other locations in front surface 1105 may be used for weight placement. Furthermore, weights 1106 may also be attached to various locations on a back surface 1109 of interchangeable bridge member 1104.

Those skilled in the art will realize that weights 1106 may be made of various shapes such as rectangle, oval, triangle, trapezoid, square or other symmetrical or asymmetrical shapes. Furthermore, weights 1106 may also be made of various materials such as stainless steel, carbon steel, titanium, aluminum, tungsten, graphite, polymers, plastics or composites. In addition, weights 1106 may be interchangeable with a plurality of alternative weights having different shapes and masses.

Weights 1106 may be connected to the front surface 1105 or back surface 1109 of interchangeable bridge member 1104 using a tool designed to fit into holes 1110. Weights 1106 may include threads for attached weights 1106 to interchangeable bridge member 1104. Those skilled in the art will also realize that more than one weight 1106 may be attached to interchangeable bridge member 1104.

In an aspect of the invention, various interchangeable bridge members having different weights may be used to change the characteristics of a golf club head. The different interchangeable bridge members may be changed through loosening of set screws 1110. In an embodiment, a golf club head using different interchangeable bridge members may be used to form a complete set of iron golf clubs.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. A golf club head comprising:
a heel;
a toe;
a top portion;
a sole portion;
a striking face extending from the top portion to the sole portion, the striking face providing a contact area for engaging a golf ball;
a rear face opposite the striking face, the rear face defining a rear cavity;
an interchangeable bridge member extending across the rear cavity, the interchangeable bridge member comprising a first height dimension in an area adjacent the heel, a second height dimension in an area adjacent the toe, and a third height dimension between the heel and toe, the third height dimension being less than the first height dimension and the second height dimension, the interchangeable bridge member configured to be separated and spaced apart from the top portion and the sole portion at a location between a heel end and a toe end of the rear cavity wherein the sole portion at the location includes an entire sole and an entire thickness of the head from the sole to the rear cavity from front to back of the head and the top portion at the location includes an entire top and an entire thickness of the head from the top to the rear cavity from front to back of the head, the interchangeable bridge member further comprising:
a first portion;
a second portion connected to the first portion, the second portion offset from the first portion; and
third portion connected to the second portion, the third portion offset from the second portion, the interchangeable bridge member varying a center of gravity of the golf club head with respect to the striking face.

2. The golf club head of claim 1, wherein the second portion is offset in a direction towards the sole portion.

3. The golf club head of claim 1, wherein the interchangeable bridge member connects the heel and toe.

4. The golf club head of claim 3, wherein interchangeable bridge member is connected to the heel and toe with screws.

5. The golf club head of claim 1, wherein first portion and third portion of the interchangeable bridge member is composed of the same material.

6. The golf club head of claim 5, wherein the second portion of the interchangeable bridge member is composed of a different material relative to the first and third portions of the interchangeable bridge member.

7. The golf club head of claim 1, wherein the interchangeable bridge member comprises a substantially uniform thickness.

8. A golf club head comprising:
a heel;
a toe;
a top portion;
a sole portion;
a striking face extending from the top portion to the sole portion, the striking face providing a contact area for engaging a golf ball;
a rear face opposite the striking face, the rear face defining a rear cavity;
an interchangeable bridge member extending across the rear cavity, the interchangeable bridge member comprising a first height dimension in an area adjacent the heel, a second height dimension in an area adjacent the toe, and a third height dimension between the heel and toe, the third height dimension being less than the first height dimension and the second height dimension, the interchangeable bridge member configured to be separated and spaced apart from the top portion and the sole portion at a location between a heel end and a toe end of the rear cavity wherein the sole portion at the location includes an entire sole and an entire thickness of the head from the sole to said rear cavity from front to back of the head and the top portion at the location includes an entire top and an entire thickness of the head from the top to the rear cavity from front to back of the head, the interchangeable bridge member further comprising:
a first portion;
a second portion connected to the first portion, the second portion offset from the first portion in a direction towards the top portion; and
a third portion connected to the second portion, the third portion offset from the second portion, the interchangeable bridge member varying a center of gravity of the golf club head with respect to the striking face.

9. The golf club head of claim 8, wherein the interchangeable bridge member connects the heel and toe.

10. The golf club head of claim 9, wherein interchangeable bridge member is connected to the heel and toe with screws.

11. The golf club head of claim 8, wherein interchangeable bridge member comprises a removable interchangeable bridge member.

12. The golf club head of claim 8, wherein the rear cavity includes a tab for connecting an end of the interchangeable bridge member.

13. The golf club head of claim 8, wherein first portion and third portion of the interchangeable bridge member is composed of the same material.

14. The golf club head of claim 13, wherein the second portion of the interchangeable bridge member is composed of a different material relative to the first and third portions of the interchangeable bridge member.

15. The golf club head of claim 8, wherein the interchangeable bridge member comprises a substantially uniform thickness.

16. A golf club head comprising:
a heel;
a toe;
a top portion;
a sole portion;
a striking face extending from the top portion to the sole portion, the striking face providing a contact area for engaging a golf ball;
a rear face opposite the striking face, the rear face defining a rear cavity;
an interchangeable bridge member extending across the rear cavity, the interchangeable bridge member having a top edge and a bottom edge, the interchangeable bridge member further comprising:
a first portion most proximate the heel;
a second portion connected to the first portion such that the top edge and the bottom edge of the interchangeable bridge member are offset at the second portion with respect to the first portion;

a third portion most proximate the toe and connected to the second portion such that the top edge and the bottom edge of the interchangeable bridge member are offset at the third portion with respect to both the first portion and the second portion;

a first transition portion connecting the first portion to the second portion, wherein the top and bottom edges of the interchangeable bridge member are inclined more steely at the first transition portion as compared to the top and bottom edges at the first portion and the second portion, making the top and bottom edges offset at the second portion with respect to the first portion; and a second transition portion connecting the second portion to the third portion. wherein the top and bottom edges of the interchangeable bridge member are inclined more steeply vertical at the second transition portion as compared to the top and bottom edges at the second portion and the third portion, making the top and bottom edges offset at the third portion with respect to the second portion, the interchangeable bridge member varying a center of gravity of the golf clubhead with respect to the striking face.

17. The golf club head of claim 16, wherein the top and bottom edges of the interchangeable bridge member are inclined with a linear slope at the first transition portion and the second transition portion.

18. A golf club head comprising:

a heel;

a toe;

a top portion;

a sole portion;

a striking face extending from the top portion to the sole portion, the striking face providing a contact area for engaging a golf ball;

a rear face opposite the striking face, the rear face defining a rear cavity; and an interchangeable bridge member extending across the rear cavity, the interchangeable bridge member having a top edge and a bottom edge and comprising a first height dimension in an area adjacent the heel, a second height dimension between the heel and toe, and a third height dimension in an area adjacent the toe, the second height dimension being less than the first height dimension and the third height dimension, the interchangeable bridge member further comprising:

a first portion most proximate the heel and having the first height dimension;

a second portion connected to the first portion and having the second height dimension, the second portion offset from the first portion;

a third portion most proximate the toe, the third portion connected to the second portion and having the third height dimension, the third portion offset from the second portion, wherein the first, second, and third height dimensions are measured parallel to each other between the top edge and the bottom edge:

a first transition portion connecting the first portion to the second portion, wherein the top and bottom edges of the interchangeable bridge member are inclined more steeply vertical at the first transition portion as compared to the top and bottom edges at the first portion and the second portion, making the second portion offset from the first portion; and a second transition portion connecting the second portion to the third portion, wherein the top and bottom edges of the interchangeable bridge member are inclined more steeply vertical at the second transition portion as compared to the top and bottom edges at the second portion and the third portion, making the third portion offset from the second portion, the interchangeable bridge member varying a center of gravity of the golf club head with respect to the striking face.

19. The golf club head of claim 18, wherein the top and bottom edges of the interchangeable bridge member are inclined with a linear slope at the first transition portion and the second transition portion.

* * * * *